US005381872A

United States Patent [19]

Peruzzi et al.

[11] Patent Number: 5,381,872

[45] Date of Patent: Jan. 17, 1995

[54] SCAFFOLD SYSTEM

[76] Inventors: Victor M. Peruzzi, 12136 Palisades Dr.; Joseph G. Peruzzi, 3512 King Dr., both of Dunkirk, Md. 20754

[21] Appl. No.: 222,525

[22] Filed: Apr. 4, 1994

[51] Int. Cl.[6] ..... E04G 1/18

[52] U.S. Cl. ..... 182/63; 182/113; 182/223

[58] Field of Search ..... 182/63, 62.5, 141, 113, 182/223

[56] References Cited

U.S. PATENT DOCUMENTS

| | | | |
|---|---|---|---|
| 3,197,178 | 7/1965 | Nietz | 182/63 X |
| 3,493,079 | 2/1970 | Dudschas | 182/141 |
| 3,516,512 | 6/1970 | Kupke | 182/63 X |

*Primary Examiner*—Alvin C. Chin-Shue

[57] ABSTRACT

An extendable and collapsible scaffold structure mounted on an aerial lift with worker controlled means for raising and lowering the same relative to an area to facilitate working thereon. Work tables, tools and safety railings are provided on the scaffold to allow the workers to prepare the material to be applied to the work area under safe conditions.

16 Claims, 8 Drawing Sheets

SCAFFOLD SYSTEM

FIELD OF INVENTION

The invention relates to an all terrain aerial lift with ground engaging stabilizers that support an above ground extensible and collapsible scaffold system, which includes movable safety railings, a work bench supported thereon, appropriate tools, and operator control means for raising and lowering the lift.

DESCRIPTION OF THE PRIOR ART

In many industrial applications, scaffolding supported by pump jacks give workers access to elevations above ground level. For example, in the installation of siding on housing, the workers must have access to the full width of a house, or a portion of its length, and move up and down adjacent to the side of the house. Typically it is necessary for the workers to move pump jacks, scaffolding, safety railings, etc. to the site, and erect the same for elevational movement adjacent the side of the house. Thereafter, two workers stand on the scaffold while another worker on the ground cuts the siding and hands the same to the workers on the scaffold for application. After several levels of siding are applied, the scaffolding is continually raised to present a new work surface until completion. After completion of one side, the pump jacks, scaffold and railings are disassembled, moved to another side of the house and reassembled where the process is repeated. As is apparent, this operation is both time consuming and fatiguing to the workers. It is, therefore, an object of the invention to provide a system for readily raising and lowering workers adjacent an elevated work surface to obviate the known laborious process. The present invention overcomes the known disadvantages of this process by simply mounting a worker controlled extensible and collapsible scaffolding structure on an aerial lift supported on a vehicle whereby all areas of the work surface become accessible without requiring assembly and disassembly of the scaffolding. Once the work is completed the vehicle can then be moved to another site where the process is repeated.

Another object of the invention is to provide foldable safety railings, access ladders, and windscreens for the scaffold which are contained within the length thereof for convenient transport to the construction site.

A further object of the invention is to provide a work bench, cutters and necessary tools which permits all the preparatory work to be done by the workers on the lift.

A still further object of the invention is to support the scaffold system with an aerial lift that includes outrigger stabilizers that secure the same notwithstanding vertical variations of the terrain.

DETAILED DESCRIPTION OF THE DRAWINGS

DESCRIPTION OF THE PREFERRED EMBODIMENT

Figure 1:
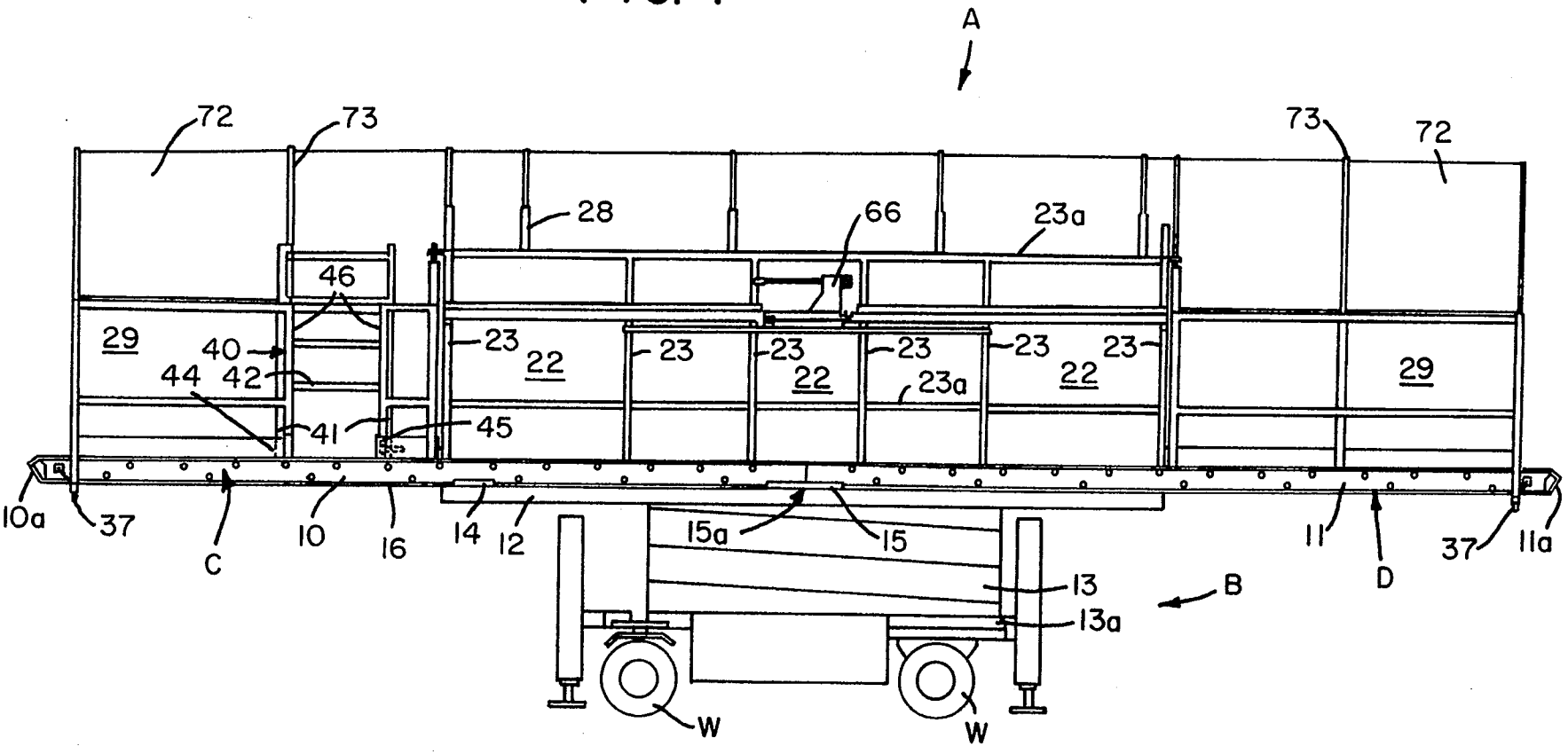
FIG. 1 is a side view of the aerial lift and scaffold system in its extended working position.

With reference to FIG. 1 the scaffold system of the present invention is designated generally as A and is seen to be comprised of sections C,D mounted on an aerial lift B. Sections C and D are basically identical and each comprise a main support 10,11 which when extended have their abutting ends supported by the lifting base 12 of aerial lift B.

Figure 3:
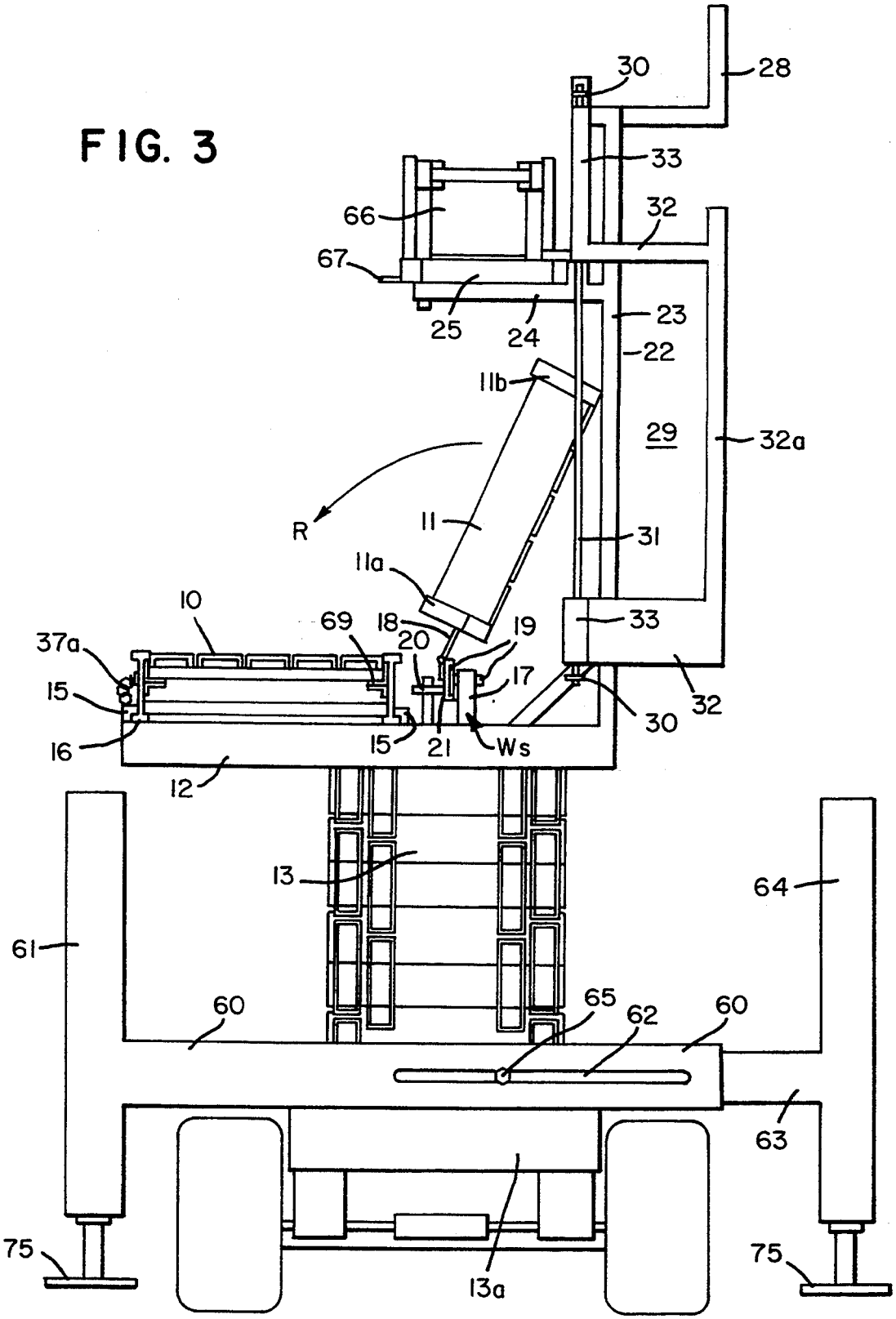
FIG. 3 is a right end view of the aerial lift and scaffold system in its collapsed position.
Figure 4:
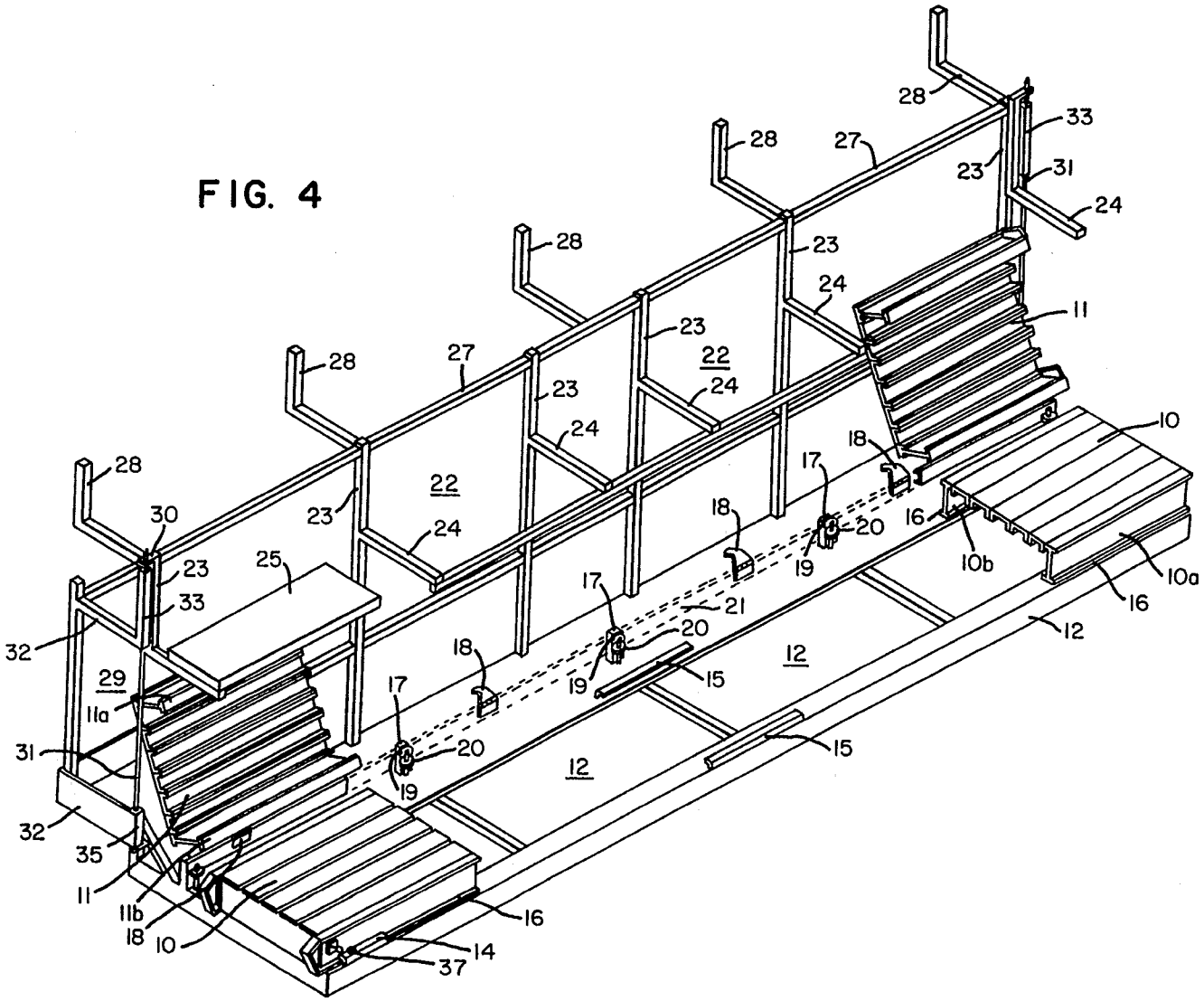
FIG. 4 is an isometric view of the scaffold system showing a section connected to a hinge, roller, and track assemble for moving the same.

As more clearly seen in FIG. 4, support 10 is formed by a pair of I-beams **10*a*, 10*b* with a deck spanning the same. The lower flanges 16,16 of the I-beam are disposed beneath pairs of spaced, inverted L-shaped retention members 14,14 and 15,15 welded or otherwise secured to base 12 along the longitudinal edges thereof. These pairs of members 14,15 captively hold support 10 and permit the same to slidably reciprocate with respect to base 12. With reference to FIG. 3 and continuing reference to FIG. 4, the other support 11, which is of similar construction as support 10 includes supporting I-beams 11*a*, 11*b*, with I-beam 11*a* having a plurality of hinges 18, disposed along its length with one leaf connected to I-beam 11*a* and the other leaf to a U-shaped track 21 extending the length of I-beam 11*a*. A plurality of spaced roller supports, the details of which are more clearly seen in FIG. 3, are disposed along the edge of base 12 adjacent I-beam 11*a* and cooperate with track 21 to aid in its movement as will become apparent hereinafter. These supports each include a vertically disposed post 17 secured to base 12 supporting a vertically disposed roller 10 at the top thereof which is captively maintained for movement within the legs of track 21. A plurality of opposing horizontally disposed guide rollers 20 cooperate with rollers 19 and engage the opposite side of the track 21 permitting the track 21 and, therefore, the section to slide therealong. As seen in FIG. 3, section 11 is vertically and angularly disposed behind section 10 in its stored or collapsed position and when it is desired to extend the same, the end is grasped and pulled rearwardly with the track 21 rolling between the rollers 19,20 until the inner end reaches and clears the middle support 15 whereat the same is rotated downwardly in the direction of arrow R. Section 11 is then pushed inwardly until the lower edges of the flanges 11*a*,11*b* are aligned and disposed beneath the pairs of L-shaped retention members 14,15 to be held in place thereby. Previous to the movement of section 11, section 10 has been previously moved to its extended position as discussed hereinabove whereby the inner ends of each section 10,11 will abut at 15*a*** thereby providing an elongated walkway for the workers as shown in FIG. 1.

As government safety regulations require the provision of railings for scaffolding when disposed in a working position, the present invention provides a railing that extends the length of the scaffold sections 10 and 11 and base 12 to protect the workers as they operate on the same. To this end, a fixed railing section designated generally as 22 is secured to the base 12 as seen in different perspective in FIGS. 1–6 and is comprised of a plurality of spaced vertical struts 23 connected to lower horizontal bars 23*a* and top rail 27.

As clearly seen in FIG. 4, each of the vertical struts 23 have an inwardly horizontally disposed bar 24 which collectively forms a support for an elongated work table 25 extending the length thereof. The top rail 27 and the upper ends of the struts 23 support a plurality of L-shaped elements 28 with the vertical leg thereof being disposed parallel to the struts 23. This arrangement permits elongated work material to be stored thereon.

Each of the sections 10 and 11 are provided with an auxiliary railings 29,29 and end railings 34,34 which when moved from a collapsed storage position to a work position cooperate with the fixed railing 22 of base 12 to entirely enclose the scaffold.

Figure 2:
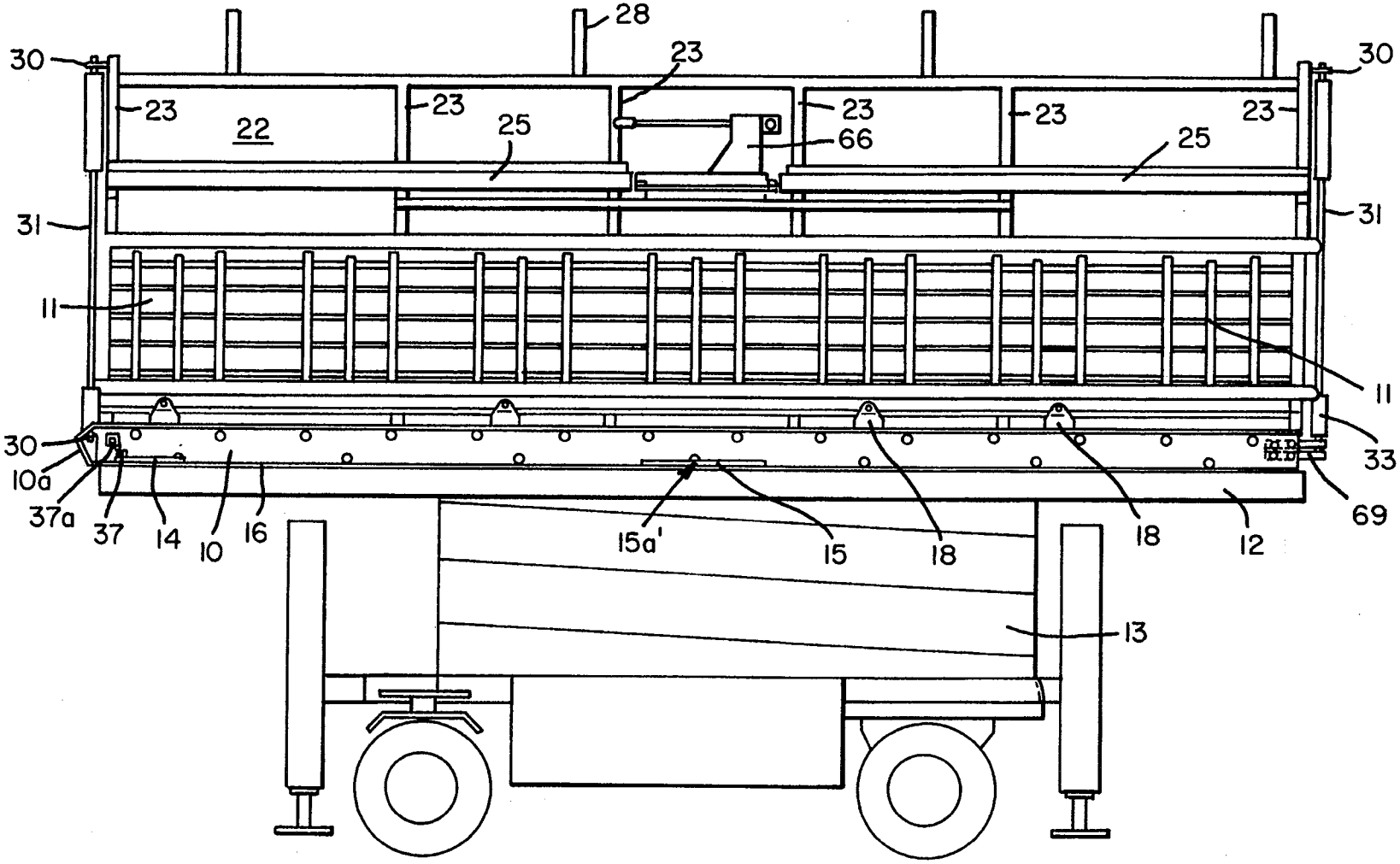
FIG. 2 is a side view of the aerial lift and scaffold system in its collapsed storage position.

Each of the auxiliary railings 29,29, which are generally identical, are seen in the end view of FIG. 3 and is of generally C-shaped configuration formed by upper and lower members 32,32 connected by a vertical member 32. The free ends 33,33 at the ends of the members 32,32 rotatably engage upper and lower portions of shaft 31 secured to the ends of fixed railing 22, as best seen in FIG. 2, by plates 30,30. These auxiliary sections 29,29 when needed are merely rotated about their respective shafts 31 as shown by the arrow S in FIG. 5 to extend the railings to or adjacent the ends of the sections 10,11.

Figure 5:
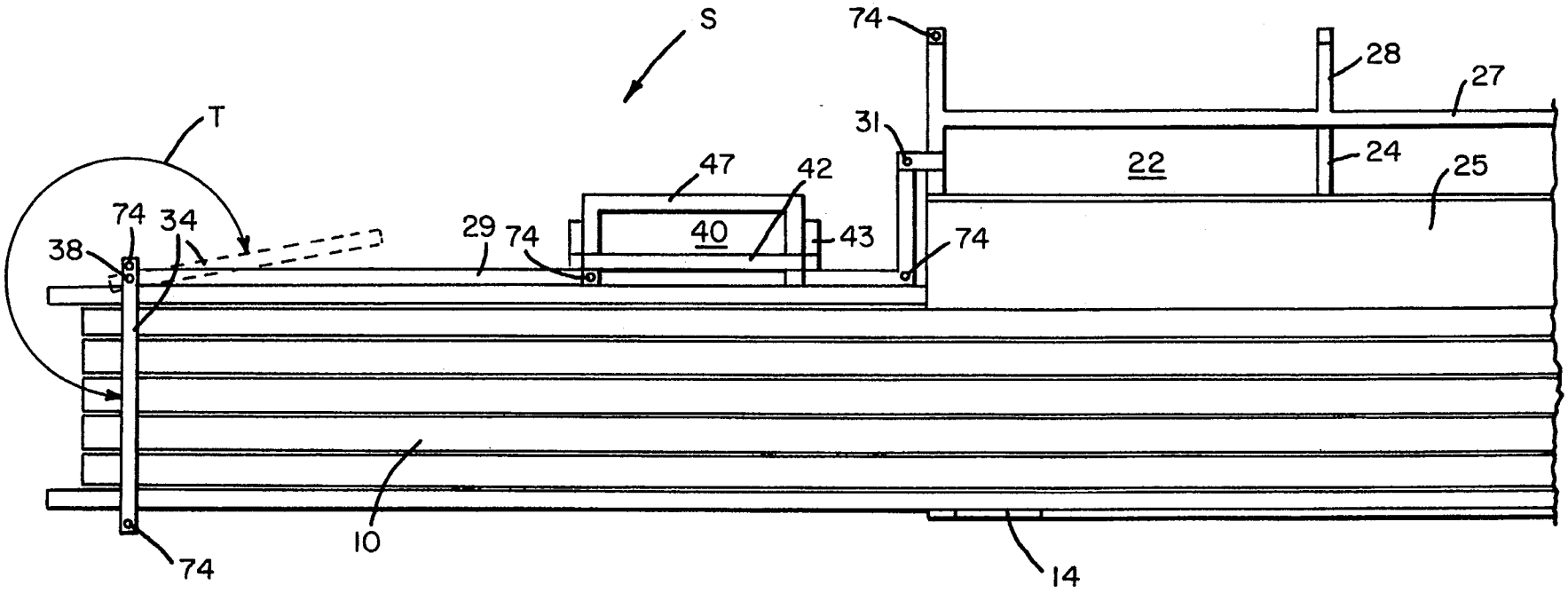
FIG. 5 is a top view showing a movable railing and associated end gates interacting with a scaffold section.
Figure 6:
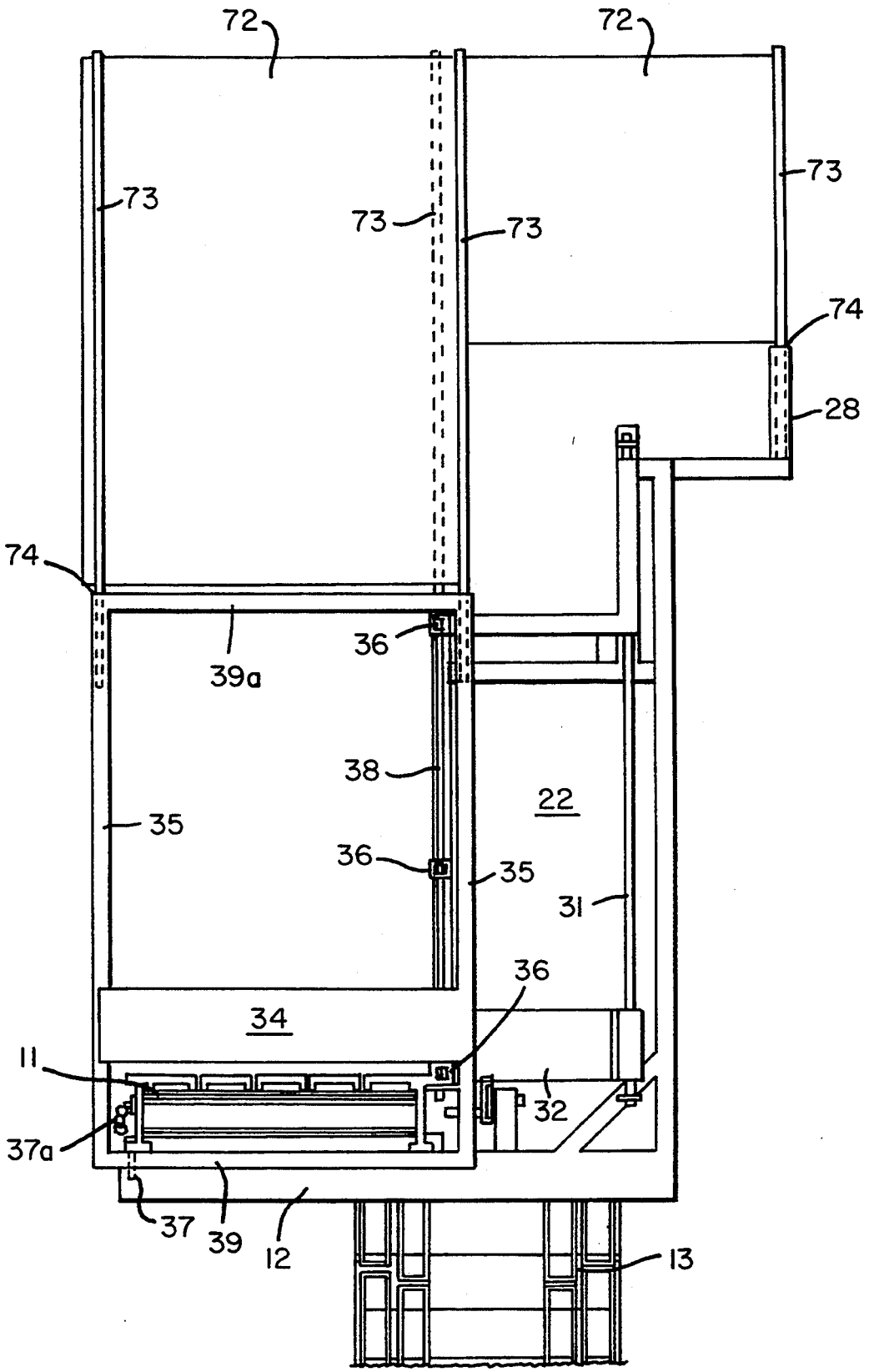
FIG. 6 is a right end view of the stationery railing the movable railing and end railing interacting with one of the scaffold sections.
Figure 10:
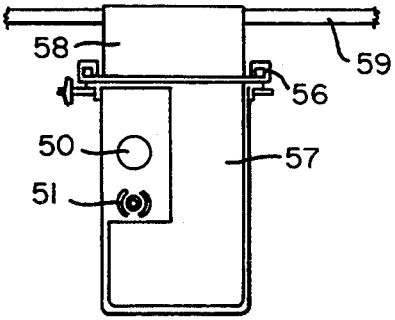
FIG. 10 is a top view of the control panel.
Figure 9:
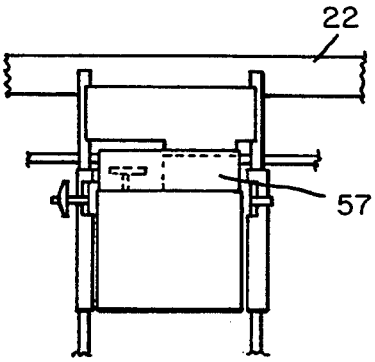
FIG. 9 shows the control panel in its raised elevated position.
Figure 8:
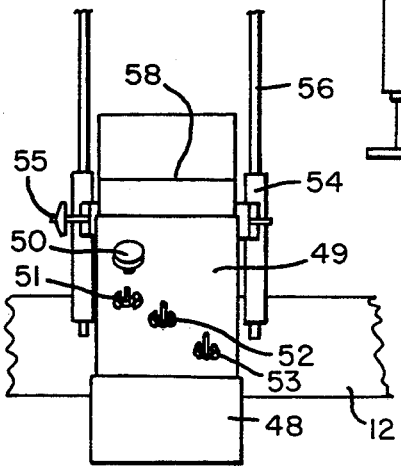
FIG. 8 shows the control panel in its lowered position.

With continuing reference to FIG. 5, the auxiliary rails 29,29 only one being shown, supports an end gate 34 which is movable from the dotted line storage position to the full line extended position as shown by the arrow T. The end gate is of generally rectangular construction having vertically disposed posts 38,38 connected at their lower end by a pair of spaced crosspieces 39,39 and a top rail 39*a*. When rotated, the gate 34 closed the open ends of its respective sections 10,11 and thus provides a safety barrier for the workers. As seen in FIG. 6, the design of the end gate when moved has its lower spaced crosspieces 39,39 straddling the end of the section 11 to provide a compact fit therewith. A tethered pin 37,37*a* extends through aligned openings in the I-beam and lower crosspiece 39 to lock the same in place.

Figure 7:
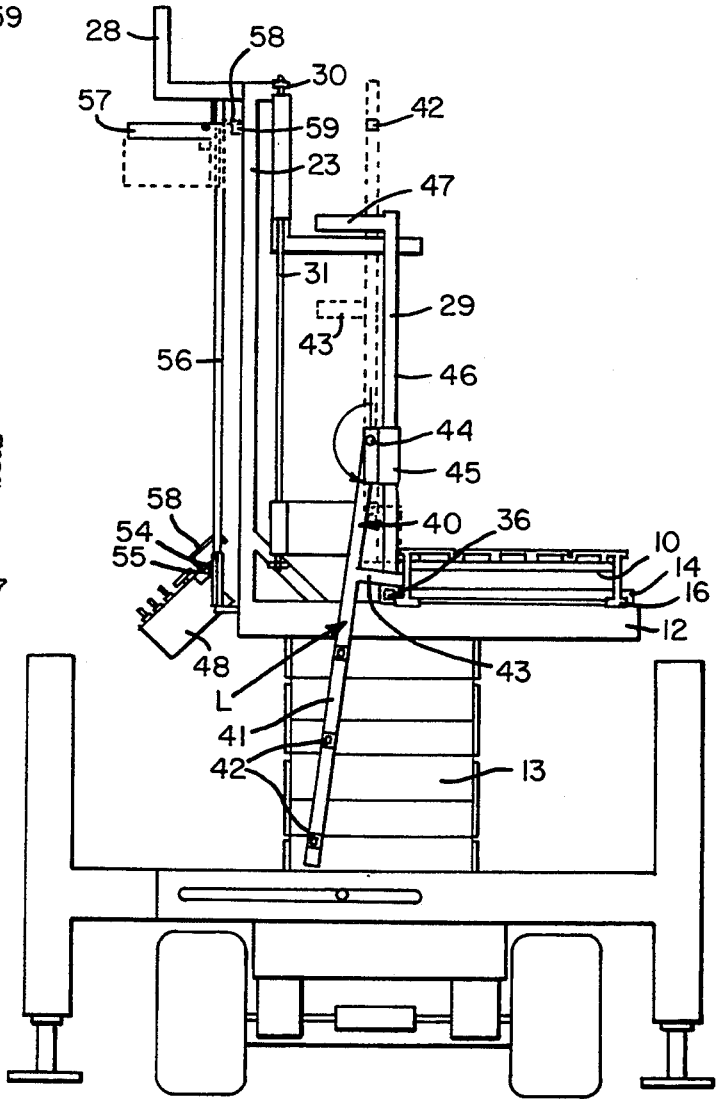
FIG. 7 shows an end view of a ladder and control panel for the lift.

To assist workers in accessing the scaffold and as also required by government regulations, a ladder designated generally as 40, as seen in FIG. 7, is provided and conventionally includes stringers 41,41 and spaced rungs 42. The upper ends of the stiles 41 are pivoted at 44 to a pair of spaced sliders which engage vertical struts 46,46 of auxiliary railing 29 as shown in FIG. 1. Each stile 41,41 is provided with ladder stops 43,43 to limit the pivotal movement thereof when the same is moved from the dotted line stored position to the solid line use position. The vertical struts 46,46 to which the ladder is secured is further provided at its upper end with a U-shaped top rail to further ensure the worker's safety as he scales the ladder see also FIG. 5.

The scaffolding structure of the present invention is further designed to readily removably receive windscreens to protect the workers in inclement weather in a simple and efficient manner. As seen in FIG. 1 the windscreen is comprised of a length of flexible screen 72 supported on spaced poles 73 which is unrolled and stretched about the scaffold sections by placing the ends of the poles 72 into the open ends of the L-shaped members 28, FIG. 4, and into the vertical struts 74 of the auxiliary railings 29. To remove the same when not needed the process can be reversed and the screen returned to its rolled storage position until further needed.

Figure 11:
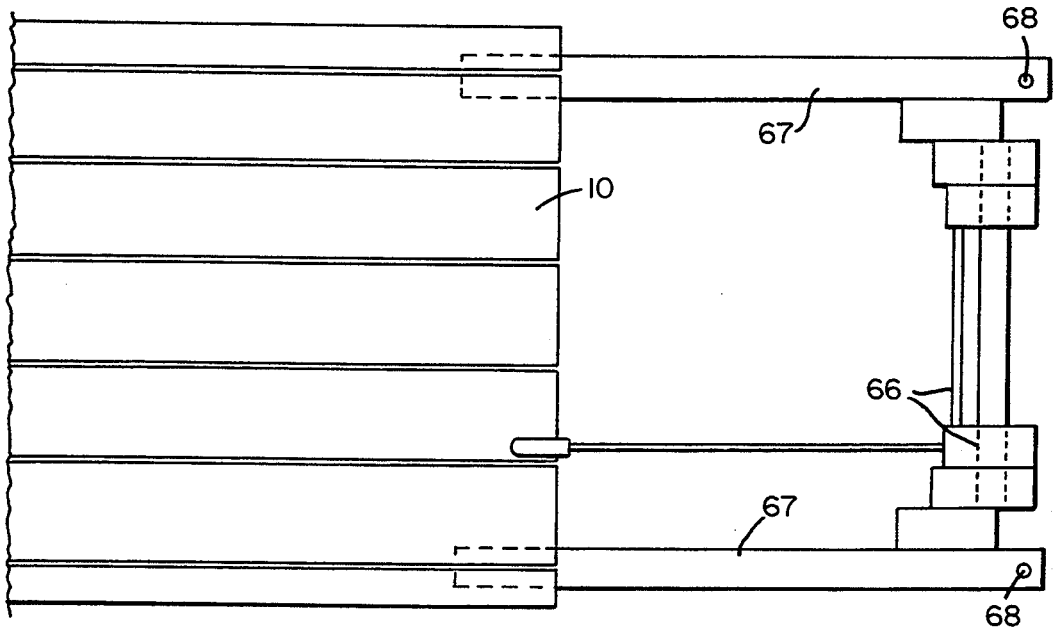
FIG. 11 is a top view of a cutter attached to one end of a scaffold section in its operating position.
Figure 12:
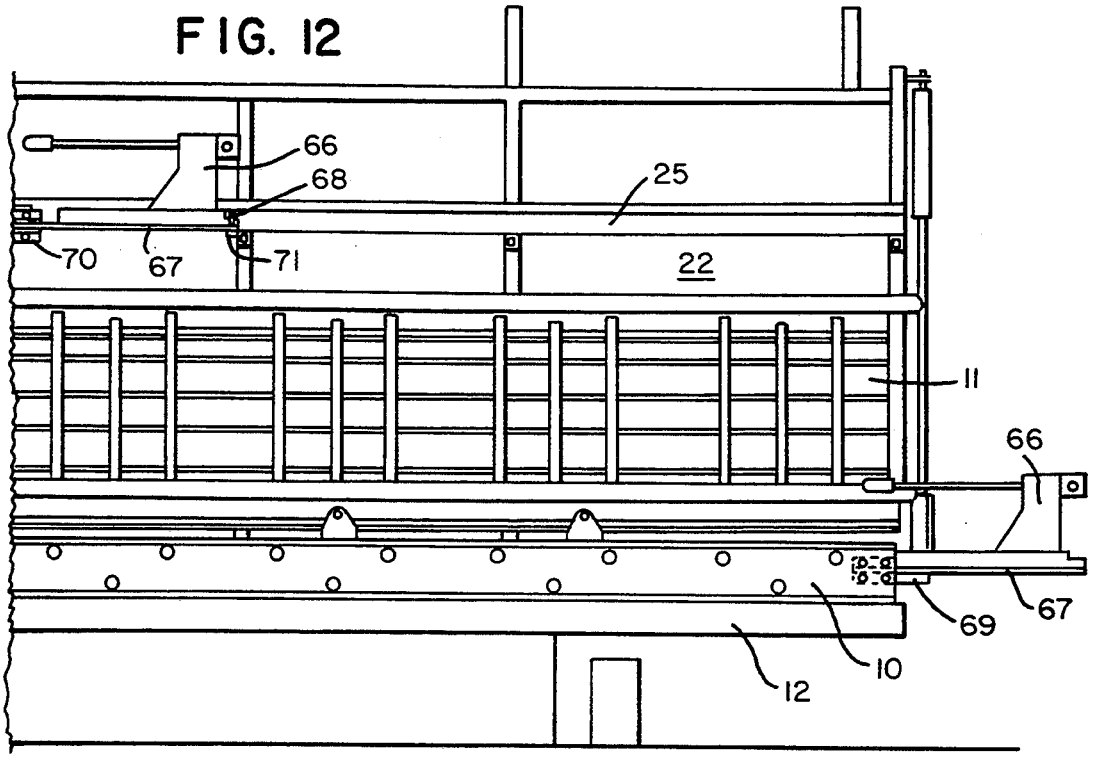
FIG. 12 is a side view of the cutter of FIG. 11 and also shows an optional position of the same.

As one of the primary uses for the scaffolding of the present invention was for the placing of siding on a building, provision was made to incorporate a work storage area, work tables, and cutters thereon to facilitate the preparation of the siding without the assistance of ground workers. To this end, the L-shaped supports 28,28 receive the siding thereon, the work table 25 receives the siding to be installed, and the cutter 66 is utilized to cut and trim the same. As seen in FIGS. 11 and 12, the cutter 66 is mounted on and supported between elongated beams 67,67. The supports 67,67 can optionally be received in either corresponding support openings 69,69 provided at the end of scaffold section 10 or in spaced openings 70,70 in work bench 25 depending on the level at which the siding is being applied. When associated with the work bench 25, pins 71,71 are utilized to lock the same in place by inserting the same into openings 68,68.

To further facilitate the placing of siding in an efficient manner, the scaffold structure is placed on aerial lift 13. The lift 13, as seen in many of the views, can be of any commercial type which permits the raising and lowering of the scaffolding as required and can be attached to the base 12 in any suitable fashion. The lift is in turn mounted on a wheeled W,W, steerable chassis 13*a* permitting ready movement of the same from site to site. Each end of the chassis 13*a* is provided with outriggers at either end for stabilizing and levelling the same not withstanding vertical variations of the terrain. The details of the outriggers are seen in FIG. 3 and are comprised of two generally T-shaped tubular members 60,63 with member 63 being slidably received within the member 60 which is fixed to the chassis 13*a*. Transverse legs 61,64 extend from the tubular members 60,63 and terminate in ground engaging foot pads 75, 75. Width wide adjustment is provided by a cooperating slot 62 formed in member 60 and a locking bolt 65 secured to the inner tube 63. Legs 61,64 have cylinders or the like disposed (none shown) therein which permit the extension of ground plate 75 to permit levelling of the same with respect to one another in a known manner.

Movement of chassis 13*a* is controlled by a switch box 48 as seen in FIGS. 7. 8, 9 and 10. Box 48 has sliding members 54,54 secured to either side thereof which engage a pair of spaced, fixed rods 56,56 secured to a vertical member 23 of the scaffold, as seen in FIG. 7. By loosening tightening bolts 55, the control box can be adjusted in a vertical plane for accessing the same. Switches 50,51,52,53 are provided to activate and control the movement of the chassis 13*a* and lift 13 in a general conventional manner. A switch box cover 57 is provided adjacent the top of these rods whereby the same serves to cover selected switches exposing only start switch 50 and lift switch 51 thereby ensuring that the operator cannot move the vehicle when standing on the scaffold walkway.

In operation, the scaffold is moved to a job site by controlling the movement of the wheeled vehicle by manipulation of the switches on panel 48. The vehicle is then anchored in place and levelled by adjusting the outriggers 61,63 and the foot pads 75,75. Thereafter scaffolding sections 10,11 are moved outwardly with respect to support base 12 by first grasping the end of section 10 and sliding it outwardly relative to captive elements 14,15. The end of section 11 is then grasped and pulled whereby the rail 21 slides on the roller supports until it can be rotated downwardly whereat it is pushed inwardly under the captive element 14,15 to engage the inner end of section 10 to provide an elongated walkway for the workers. The walkway can then be raised and lowered as required by controlling the lift with respect to the area to be worked upon. Ladders, safety railings, windscreens, storage areas, work tables and tools are provided on the scaffolding to allow the workers easy access to the same while preparing the work under the utmost of safety conditions. After completing the job, the process is reversed to collapse the scaffolding to a storage position for later use.

I claim:

1. A scaffold structure including a support base, a first scaffold section, means mounting the first scaffold section for inward and outward movement with respect to the base, a second scaffold section superposed over said first scaffold section, means mounting the second scaffold section for inward and outward movement with respect to the base, and means on said base for securing said first and second sections in abutting relation when each of said sections are in an extended position.

2. The scaffold structure of claim 1 wherein said base is mounted on a lift, and means are provided for raising and lowering said lift.

3. The scaffold structure of claim 2 wherein said lift is mounted on a steerable wheeled chassis.

4. The scaffold structure of claim 1 wherein the said base and said first and said second sections are provided with safety railings extending upwardly therefrom.

5. The scaffold structure of claim 4 wherein the said base railing is fixed thereto and the railings of said first and said second sections are pivotally connected to the ends of the base railings and disposed therebehind and movable to an extended position in general alignment with said first fixed railing.

6. The scaffold of claim 5 further including end gates, means pivotally securing the same to respective ends of the auxiliary railings and movable to an end section closing position, and means for locking the same in place.

7. The scaffold structure of claim 1 wherein the said second section has means pivotally securing the same to a rail, and roller means are disposed within said rail permitting the rail to move thereover to an extended position.

8. The scaffold structure of claim 7 further including a plurality of rollers engaging the other side of the rail to constrain the movement thereof.

9. The scaffold structure of claim 8 wherein the said second section is disposed in a generally vertical position with respect to said first section and wherein said pivot means permits the same to be rotated downwardly in alignment with said first section.

10. The scaffold structure of claim 4 wherein the base railing includes vertical support members having opposed arms extending therefrom to provide support surfaces for storing material and supporting a work table.

11. The scaffold structure of claim 3 further including outrigger stabilizing and levelling means disposed at either end of said vehicle.

12. The scaffold structure of claim 3 wherein control means are provided to control the movement of said vehicle and said lift.

13. The scaffold structure of claim 12 further including a pair of spaced rods mounted on said auxiliary railing, slide means secured to said control means engaging said rods for vertically reciprocating the same, and means for locking the control means in adjusted position.

14. The scaffold structure of claim 13 further including a ladder, pivot means mounting said ladder on one of said auxiliary railings for movement from a storage position to a base engaging accessible position.

15. The scaffold structure of claim 14 further including cutter means, a pair of spaced rods supporting the cutter means thereon, said rods being adapted to be selectively positioned in corresponding openings provided in said section or said table.

16. The scaffold structure of claim 15 wherein a windscreen is disposed on said main railing and auxiliary railing by inserting support rods in respective openings thereof.

* * * * *